US005212976A

United States Patent [19]

Company

[11] Patent Number: 5,212,976

[45] Date of Patent: May 25, 1993

[54] METHOD AND APPARATUS FOR CONTROLLING SHOT PEENING DEVICE

[75] Inventor: José Company, Villeneuve St Georges, France

[73] Assignee: Societe Nationale d'Etude et de Construction de Moteurs d'Aviation (S.N.E.C.M.A.), Martial Valin, France

[21] Appl. No.: 905,469

[22] Filed: Jun. 29, 1992

[30] Foreign Application Priority Data

Jul. 3, 1991 [FR] France ..... 91 08283

[51] Int. Cl.[5] ..... B24C 1/10; B21J 1/02

[52] U.S. Cl. ..... 72/53; 29/90.7

[58] Field of Search ..... 72/53; 29/90.7; 73/861.85; 51/319

[56] References Cited

U.S. PATENT DOCUMENTS

| | | | |
|---|---|---|---|
| 3,423,976 | 1/1969 | Burney et al. | 72/53 |
| 4,848,123 | 7/1989 | Thompson | 72/53 |
| 4,873,855 | 10/1989 | Thompson | 72/53 |
| 5,113,680 | 5/1992 | Matsuura et al. | 72/53 |

FOREIGN PATENT DOCUMENTS

| | | | |
|---|---|---|---|
| 032780 | 7/1981 | European Pat. Off. . | |
| 111059 | 6/1984 | European Pat. Off. . | |
| 426341 | 5/1991 | European Pat. Off. . | |
| 2312775 | 12/1976 | France . | |
| 2590826 | 6/1987 | France . | |
| 2627414 | 8/1989 | France . | |
| 0267164 | 11/1988 | Japan | 51/319 |
| 1108003 | 8/1984 | U.S.S.R. | 51/319 |

*Primary Examiner*—David Jones
*Attorney, Agent, or Firm*—Bacon & Thomas

[57] ABSTRACT

A method and apparatus of controlling a shot peening apparatus are disclosed in which the shot peening apparatus has an enclosure in which a workpiece and a peening nozzle are located. The peening nozzle is movable between a working position and a measuring position and, when in its working position, is located a distance D from the workpiece. The shot peening apparatus may be numerically controlled in order to move the peening nozzle relative to the workpiece, or vice versa, and to move the peening nozzle between its working and measuring positions. A laser velocimeter device is utilized to establish a measurement point within the shot peening closure. At preselected points during the operational cycle of the shot peening apparatus, the nozzle is moved from its working position to a measuring position such that it is separated from the measurement point a distance D equal to the distance between the nozzle and the workpiece when in its working position. In its measuring position, the peening nozzle is operated in the same manner as in its working position such that the shot elements pass through the measurement point.

7 Claims, 2 Drawing Sheets

METHOD AND APPARATUS FOR CONTROLLING SHOT PEENING DEVICE

BACKGROUND OF THE INVENTION

The present invention relates to a method and apparatus for controlling a shot peening device including the measuring of the peening intensity during the operational cycle of the shot peening device.

Shot peening is a well known technique to impart surface compression stresses to a workpiece, such surface compression stresses serving to improve the useful life of the workpiece by increasing both fatigue and corrosion resistance under stress. Shot peening techniques involve the projection of shot elements, usually by compressed air, onto a specific zone of the workpiece surface. Shot elements are typically spherical balls and may be made of a variety of materials, such as steel, glass, or ceramics depending upon the particular material of the workpiece.

To produce workpieces of high quality with good reproducibility requires a reliable measurement means for determining the peening intensity. This is particularly true in workpieces which have aeronautical applications.

A known method for measuring shot peening intensity consists of making ALMEN type test pieces which are flat and are subjected to a shot peening jet. The shot peening intensity can be determined by measuring the stress-induced flexture of the test piece and consulting the known ALMEN measuring scale. This method entails much handling and requires test piece supports for each specific workpiece geometry, which are frequently complex, particularly workpieces relating to aeronautical engines. The measurement of the shot peening intensity can only take place before or after the workpiece has been treated. If the shot peening device undergoes any changes during the shot peening operation, unacceptable workpieces can result, since it is not possible to measure the shot-peening intensity during the operation of the shot peening device. For these reasons, this method has not been universally accepted.

Various attempts have also been made to monitor the shot peening operation by methods calling for additional quality checks, or involving controlling the parameters which determine the shot peening intensity. French Patent 2,312,775 describes a method in which the peened surfaces are inspected in relation to a control sample using a coating which radiates in a specific manner when subjected to fluorescent light. French Patent 2,627,414 describes a shot peening apparatus which includes a regulator for the supply pressure of the propellant gas and an independent control for the flow of shot elements.

U.S. Pat. No. 4,873,855 to Thompson discloses a system for using a magnetic densitometer to determine the mass of shot which, when combined with the mass flow rate, generates a signal representative of the average shot velocity.

U.S. Pat. No. 4,848,123, also to Thompson, discloses a system utilizing a force sensor in connection with the shot peening nozzle to sense the reaction force exerted on the nozzle. A signal representative of this reaction force is used to calculate the average shot particle velocity and mass flow rate.

French Patent 2,590,826 illustrates automation principles relating to shot peening equipment which includes an operational linkage between the means measuring the degree of covering of a test piece and means checking the characteristics of the shot peening jet.

SUMMARY OF THE INVENTION

A method and apparatus of controlling a shot peening apparatus are disclosed in which the shot peening apparatus has an enclosure in which a workpiece and a peening nozzle are located. The peening nozzle is movable between a working position and a measuring position and, when in its working position, is located a distance D from the workpiece. The shot peening apparatus may be numerically controlled by known control means in order to move the peening nozzle relative to the workpiece, or vice versa, and to move the peening nozzle between its working and measuring positions.

A laser velocimeter device is utilized to establish a measurement point within the shot peening closure. Laser velocimeter devices are well known in the art and any such device which enables the establishment of the measurement point within the shot peening enclosure may be utilized without exceeding the scope of this invention.

At preselected points during the operational cycle of the shot peening apparatus, the nozzle is moved from its working position to a measuring position such that it is separated from the measurement point a distance D equal to the distance between the nozzle and the workpiece when in its working position.

In its measuring position, the peening nozzle is operated in the same manner as in its working position such that the shot elements pass through the measurement point. Known data acquisition means are provided to acquire data relating to the size of the shot elements (in particular the diameter if the shot elements are spherical) the speed $V_i$ of the shot elements and the number of elements per unit time N passing across the measurement point. The data acquisition means is operatively connected to a microprocessor such that the mass m of the shot elements may be calculated from the measured size of the shot elements. The microprocessor also calculates the peening energy $E_T$ and this calculated value $E_T$ is compared with predetermined threshold values of the peening energy to achieve the desired shot peening intensity. If the calculated peening energy $E_T$ is beyond the predetermined acceptable limits for the peening energy, the shot peening apparatus is stopped via a connection between the microprocessor and the numerical control system for the shot peening apparatus.

If, on the other hand, the calculated peening energy $E_T$ is within acceptable limits, the nozzle is returned to its working position and the operational cycle of the shot peening apparatus continues. The calculation of the peening energy $E_T$ may be carried out at various stages of the shot peening operation to improve the quality control of the shot peened workpieces.

DETAILED DESCRIPTION OF THE PREFERRED EMBODIMENTS

Figure 1:
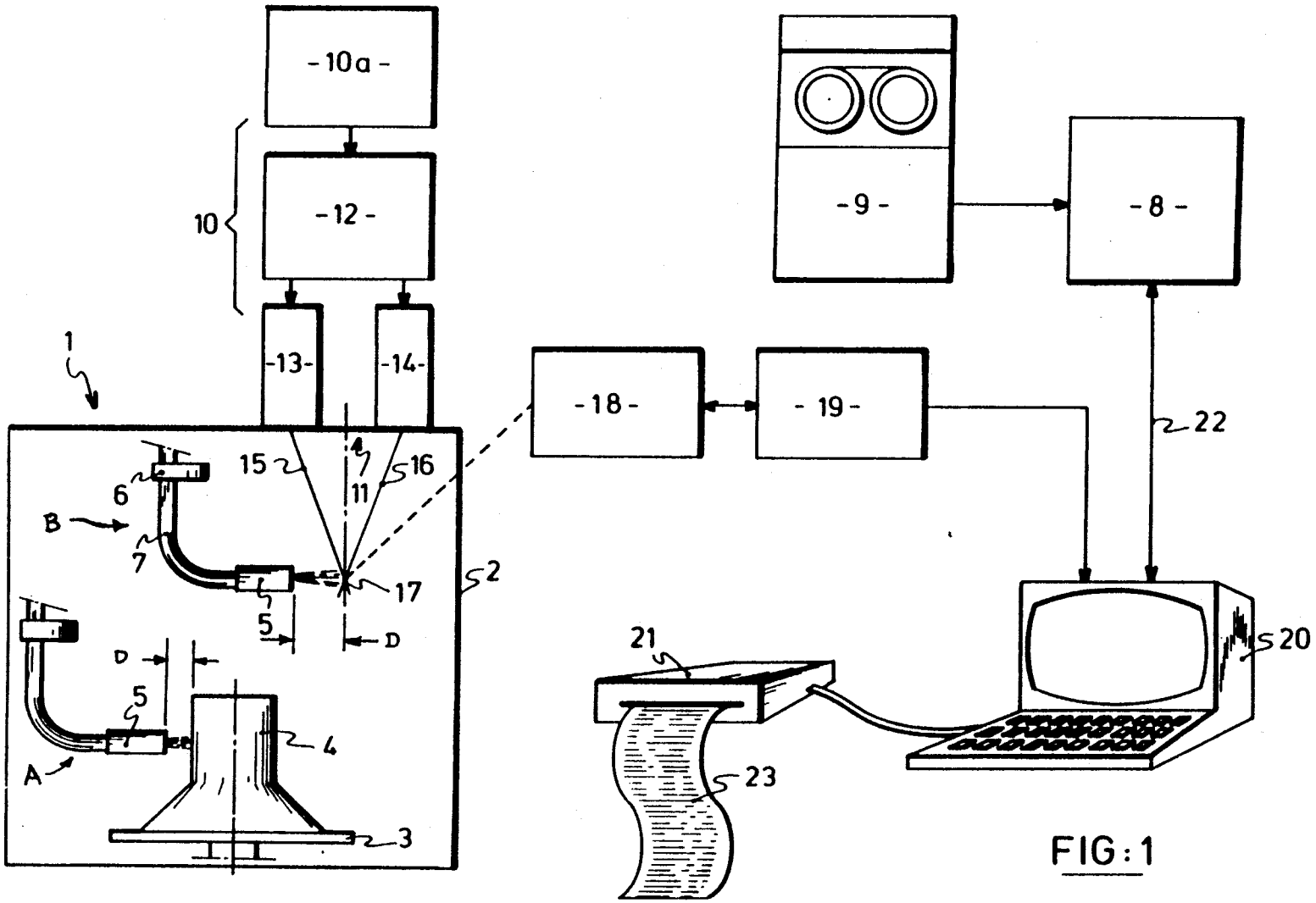
FIG. 1 is a schematic diagram of the control system for shot peening devices according to the present invention.

The invention will be described in relation to the schematic diagram illustrated in FIG. 1. This system has been found to be a particularly advantageous application of the invention for shot peening mechanical workpieces.

The desire for high quality, reproducible shot peening results entails the use of automated machinery. FIG. 1 discloses a schematic diagram of the shot peening device 1 which comprises a sealed enclosure 2. Enclosure 2 has known inlets and outlets for the connection to the peening nozzle to supply both a pressurized gas and the shot elements thereto. Since these inlets and outlets are well known, per se, they have been omitted from FIG. 1. Enclosed within enclosure 2 is a workpiece support 3 which may be movable by known motor devices. The motor devices and their respective connection to the support 3 are well known in the art, and have also been omitted from FIG. 1.

Workpiece 4 is mounted on support 3, by any known means, such that it may be movable with the workpiece support. At least one shot peening nozzle 5 is located within the enclosure 2 and is connected via element 6 to displacement means such that the nozzle can be moved within the enclosure 2. It is to be understood that peening nozzle 5 is also operatively connected to a source of pressurized gas and a source of shot elements such that the shot elements may be propelled from the peening nozzle 5 onto the workpiece 4. The details of these elements are well known in the art and have been omitted from FIG. 1. Peening nozzle 5 is connected to element 6 via conduit 7, which may be a flexible or rigid conduit.

The shot peening system according to the present invention comprises a control means 8, which may be a numerical control device whose operation is controlled by the tape program device 9.

Control means 8 controls the movement of the peening nozzle 5, as well as the workpiece support 3 during the shot peening operation. In order to direct the shot elements onto the workpiece, the nozzle is moveable into a working position, illustrated at A in FIG. 1. In this working position, the nozzle 5 is located a distance D from the surface of the workpiece 4 which is to be shot peened.

The system according to the present invention provides a method and apparatus for determining the peening energy before, during, or after the operational cycle of the shot peening device. This is accomplished by a laser velocimeter device 10, which may be located exteriorly of enclosure 2 and which may comprise a laser beam source 10*a*, a beam splitter 12 and corresponding optic devices 13 and 14 which direct the laser beams 15 and 16 into a convergent path which converges at measurement point 17 within the enclosure 2. The laser beams 15 and 16 pass into the enclosure 2 through a window 11 which may be provided with known seals and shutters. Laser velocimeters are known, per se, and the details of this system have been omitted from FIG. 1. The wave train reflection caused by the shot elements passing across measurement point 17 causes a phase shift and a change in frequency generating interference fringes constituting a signal which is picked up by detector 18. Detector 18 transmits this signal to processing circuitry 19 which, in turn, is operatively connected to microprocessor 20 and printer 21.

In order to measure the peening intensity, the peening nozzle 5 is moved from its working position A into a measuring position, indicated at B in FIG. 1. In the measuring position, the end of the nozzle 5 is located distance D from the measuring point 17 which is the same as the distance D when the nozzle 5 is in its working position A. During its time in the measuring position, the peening nozzle 5 is operated in the same fashion as it is when in the working position A. The microprocessor 20 calculates the peening energy based upon the signal input from processing circuitry 19 and compares the calculated peening energy with a predetermined peening energy. Via its connection 22 to the control system 8, the microprocessor 20 controls the shot peening operation as a result of this comparison. If the calculated peening energy is within acceptable limits, the control means 8 returns the peening nozzle 5 to the working position A to continue the shot peening operation cycle. If, however, the calculated peening energy is outside the acceptable limits, the control system 8 terminates the shot peening operation.

The peening energy $E_T$ can be determined from the parameters detected by detector 18. These parameters include the size of the shot elements, in particular the diameter D if the shot is spherical, the shot element speed $V_i$ and the number of shot elements per unit time N. Once these parameters are known, the peening energy $E_T$ can be calculated by the equation:

$$E_T = \frac{[NmR_S J(Vi - Vr)e^{-ta}\cos(i)][2Vi - (Vi - Vr)e^{-ta}]}{2kV_D}$$

where:

N = the number of shot elements impacts per unit time, this parameter being the function of the geometry of the nozzle 5, the distance D, the shot element diameter and the machine configuration;

m = the mass of one shot element;

$R_S$ = the ratio of a effective surface to the total surface, this parameter taking into account the particle speed distribution at the outlet of the nozzle 5 and being indicative that only a fraction of the nominal shot element flow contributes to the energy transfer;

k = a surface covering ratio between successive passes of the nozzle 5;

J = the distance covered by the nozzle 5, the parameters k and J denoting that the movement of the shot element flow nozzle is repeated as often as necessary to cover the entire workpiece surface;

$V_D$ = the speed at which the shot nozzle 5 moves;

$V_i$ = the speed of the incident shot particles at impact with the workpiece surface;

$V_r$ = the shot element recoil speed at the first impact;

i = the shot element impact angle; and a = a constant for a particular workpiece material.

In the foregoing equation, $R_S$ is a constant for a given shot peening operation; a is a material dependent constant and, for a specific workpiece, is also constant; $V_r$ depends upon the ratio of the workpiece hardness to the shot element hardness for a given $V_i$; J, cos (i), k and $V_D$ are values determined when the shot peening operation is set up and depend only upon the kinematics between the nozzle 5 and the workpiece 4.

Accordingly, when the shot peening operation is set up and calibrated in a known manner, only the parameters N (number of impacts per unit time), m (mass of a shot element) and $V_i$ (the shot element speed at impact) need to be determined.

Figure 2:
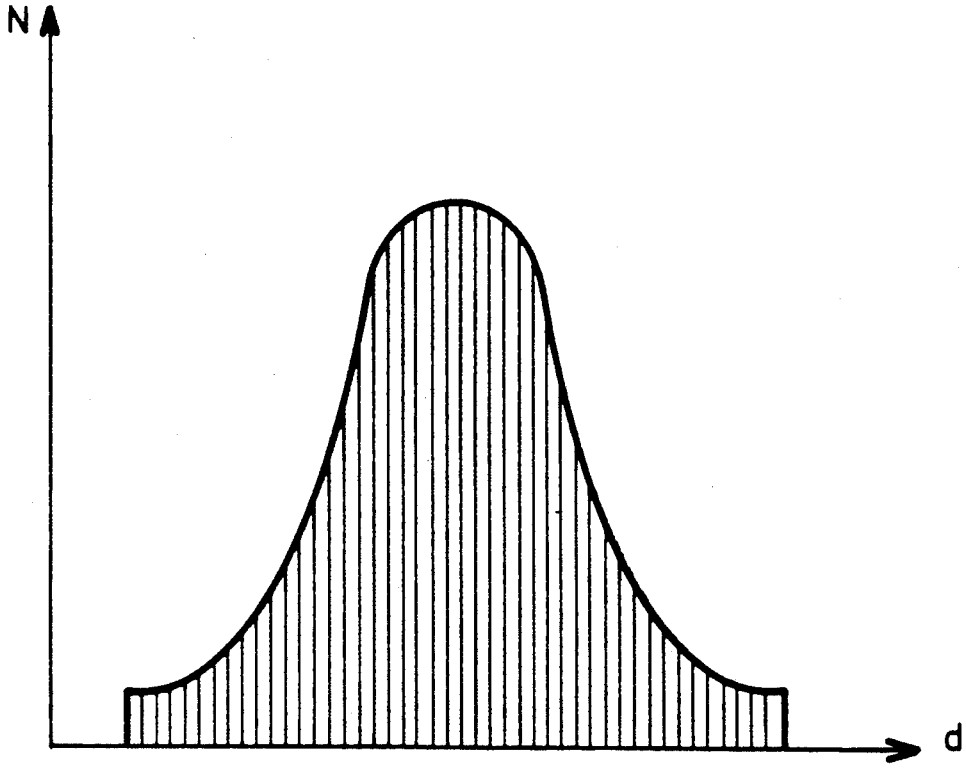
FIG. 2 is a graph of the shot element distribution curve showing the number of impacts per unit time N as a function of shot element diameter d.

These parameters can be determined by the laser velocimeter device 10 when the nozzle 5 is moved into its measuring position B. The diameter d of the individual shot elements and the speed of impact $V_i$ can be determined at the measurement point 17. The laser velocimeter device 10 provides a diagram, illustrated in FIG. 2, which is a shot element distribution curve with N as a function of diameter d. The mass m of the shot element can easily be determined from the equation:

$$m=4/3\pi d^3\mu$$

where $\mu$=the density of the shot element material.

Figure 3:
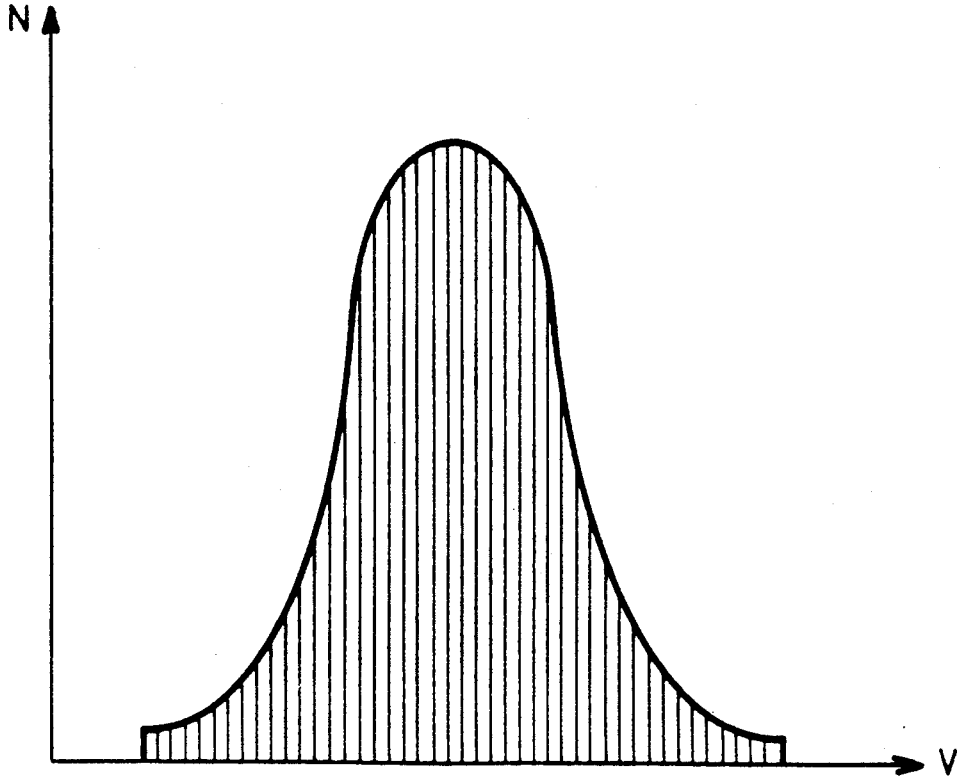
FIG. 3 is a graph showing a distribution curve of the number of impacts per unit time N as a function of shot element speed V.

The measuring system also provides a plot, as illustrated in FIG. 3, which is a distribution curve of the number of impacts per unit time N and as a function of speed V. The speed $V_i$ of the impacting shot element at measuring point 17 is determined in this manner. The system according to the invention can determine these magnitudes with an accuracy of ±2% so that the peening intensity can be checked by monitoring the peening energy $E_T$ with an accuracy equal to or better than ±4%. One of the main advantages of the system according to this invention is that the magnitudes are measured at the exit of the nozzle 5 and correspond to the actual parameters existing at the workpiece 4.

The shot peening method according to the present invention for measuring the peening energy $E_T$ effective at the workpiece 4 comprises the steps of: establishing a measurement point within the enclosure; moving the at least one peening nozzle from a working position to a measuring position wherein the nozzle is located a distance D from the measurement point; operating the nozzle in the same manner as in its working position; acquiring data relating to the shot elements passing through the measurement point, such data comprising the size shot elements, the speed of the shot elements $V_i$ and the number of shot elements per unit of time N; processing this data to calculate the peening energy $E_T$; comparing the calculated value of $E_T$ with predetermined peening energy limits $E_0$ and $E_1$ stored in a microprocessor memory; stopping the shot peening operation if the comparison indicates that the calculated peening energy $E_T$ exceeds the predetermined acceptable limits; or, if the calculated peening energy $E_T$ falls within the acceptable limits, returning the peening nozzle to its working position and continuing the shot peening operation.

The moving of the peening nozzle to its measuring position, acquiring data, calculating the peening energy and comparing this calculated energy with the predetermined limits may be carried out at various times during the shot peening operation. The specific number of times and places in the control sequence of the operation of the shot peening device may be varied according to the specific equipment involved and from experience in working the specific material of the workpiece. Actual data acquisition time is usually less than one minute, enabling several measurements to be carried out during the shot peening operation, which may last tens of minutes, without unduly increasing production costs or introducing excessive delays in the production operations.

Among its many advantages, the system according to the invention offers substantial savings in time compared with known procedures which require control test pieces to be made, especially with respect to equipment utilization time. By directly monitoring the parameters that actually effect the peening intensity, higher quality workpieces may be produced by the system according to the invention. Moreover, by using printer 21 to print out the data, as illustrated at 23 in FIG. 1, a log of control effectiveness may be kept for all shot peening operations.

The foregoing description is provided for illustrative purposes only and should not be construed as in any limiting this invention, the scope of which is defined solely by the appended claims.

I claim:

1. A method of operating a shot peening apparatus having an enclosure in which a workpiece and at least one peening nozzle are located such that, in a working position wherein the at least one peening nozzle is located a distance D from the workpiece, shot elements emanating from the at least one peening nozzle are directed onto the workpiece, comprising the steps of:

a) providing a laser velocimeter device to establish a measurement point within the enclosure;

b) moving the at least one peening nozzle from a working position to a measuring position wherein the at least one peening nozzle is located distance D from the measurement point;

c) operating the peening nozzle in the same manner as in its working position;

d) acquiring data relating to shot elements passing through the measurement point, such data comprising the size of the shot element, the speed ($V_i$) of the shot elements and the number of shot elements per unit of time (N);

e) calculating the peening energy ($E_T$) based upon the acquired data;

f) comparing the calculated peening energy ($E_T$) to a predetermined peening energy;

g) stopping the operation of the shot peening apparatus if the calculated peening energy falls outside predetermined limits from the predetermined peening energy;

h) continuing the operation of the shot peening apparatus if the calculated peening energy falls within the predetermined limits from the predetermined peening energy; and, i) returning the at least one peening nozzle to its working position.

2. The method of claim 1 further comprising carrying out steps b) through i) a plurality of times during the operation of the shot peening apparatus.

3. The method of claim 1 wherein the step of calculating the peening energy ($E_T$) is carried out by the equation:

$$E_T = \frac{[NmR_S J(Vi - Vr)e^{-ta}\cos(i)][2Vi - (Vi - Vr)e^{-ta}]}{2kV_D}$$

where:

N=number of shot elements per unit of time;

m=mass of one shot element;

D=distance from nozzle to workpiece;

$R_S$=ratio of surface being impacted by shot elements to total surface;

k=surface covering ratio between successive passes of nozzle;

J=distance covered by nozzle;

$V_D$=speed at which nozzle moves;

$V_i$=speed of shot elements at impact with workpiece;

$V_r$=shot element recoil speed after first impact;

i=shot element impact angle;

a=constant for particular workpiece material.

4. Apparatus for controlling a shot peening device having an enclosure in which a workpiece and at least one peening nozzle are located such that, in a working position wherein the at least one peening nozzle is located a distance D from the workpiece, shot elements emanating from the at least one nozzle are directed onto the workpiece, comprising:

a) a laser velocimeter operatively associated with the enclosure so as to establish a measuring point within the enclosure;

b) moving means to move the at least one peening nozzle between its working position and a measuring position wherein the at least one nozzle is located the distance D from the measuring point;

c) data acquisition means to acquire data relating to the shot elements passing through the measurement point, such data comprising the size of the shot elements, the speed ($V_i$) of the shot elements and the number of shot elements per unit of time (N);

d) calculating means operatively associated with the data acquisition means to calculate the peening energy ($E_T$) based upon the acquired data;

e) comparison means operatively associated with the calculating means to compare the calculated peening energy ($E_T$) to a predetermined peening energy; and, f) control means operatively associated with the comparison means and the moving means such that, if the calculated peening energy ($E_T$) is within predetermined limits from the predetermined peening energy, the control means moves the at least one peening nozzle back to its working position and, if the calculated peening energy ($E_T$) is not within predetermined limits from the predetermined peening energy, the control system stops the operation of the shot peening device.

5. The apparatus of claim 4 wherein the comparison means comprises computer means.

6. The apparatus of claim 4 wherein the control means comprises a numerical control system.

7. The apparatus of claim 5 further comprising data print-out means operatively associated with the computer means.

* * * * *